US012616280B2

(12) United States Patent
Charlton

(10) Patent No.: US 12,616,280 B2
(45) Date of Patent: May 5, 2026

(54) ZIPPER TAPE APPLICATOR DEVICE

(71) Applicant: CA Tool Works, LLC, Crisfield, MD (US)

(72) Inventor: Michael Charlton, Hampton, VA (US)

( * ) Notice: Subject to any disclaimer, the term of this patent is extended or adjusted under 35 U.S.C. 154(b) by 32 days.

(21) Appl. No.: 18/639,475

(22) Filed: Apr. 18, 2024

(65) Prior Publication Data

US 2024/0349849 A1 Oct. 24, 2024

Related U.S. Application Data

(60) Provisional application No. 63/461,036, filed on Apr. 21, 2023.

(51) Int. Cl.
*A44B 19/34* (2006.01)

(52) U.S. Cl.
CPC ..... *A44B 19/34* (2013.01)

(58) Field of Classification Search
None
See application file for complete search history.

(56) References Cited

U.S. PATENT DOCUMENTS

| | | | | |
|---|---|---|---|---|
| 1,948,406 A | | 2/1934 | Warshaw | |
| 2,997,099 A | * | 8/1961 | Pike | B26D 7/27 156/545 |
| 3,456,305 A | * | 7/1969 | Volt | A44B 19/34 2/265 |
| 5,500,966 A | | 3/1996 | Wheat | |
| 6,092,266 A | | 7/2000 | Lee | |
| 8,631,543 B2 | | 1/2014 | Huotari | |
| 10,506,851 B2 | * | 12/2019 | McCabe | A44B 19/24 |
| 10,532,842 B1 | * | 1/2020 | Zoss | B65H 35/008 |
| 11,623,839 B1 | * | 4/2023 | Hovde | G09F 7/16 156/249 |
| 2012/0233739 A1 | | 9/2012 | Blackford | |
| 2020/0353739 A1 | * | 11/2020 | Rodriguez | B65H 35/0073 |
| 2023/0134270 A1 | * | 5/2023 | Todaka | A44B 19/34 383/63 |

* cited by examiner

*Primary Examiner* — Michael N Orlando
*Assistant Examiner* — Abhishek A Patwardhan
(74) *Attorney, Agent, or Firm* — Brennan, Manna & Diamond, LLC

(57) ABSTRACT

A zipper tape applicator device is provided designed for the efficient application of tape to both sides of a zipper assembly. The device comprises a base with two parallel vertical members featuring cutouts to hold the axle of a spool assembly that can spin freely while securing two rolls of tape. Positioned above the base and spool assembly is a taping member with a top surface designed to guide tape from the rolls to the zipper placed upon the member. More specifically, the member includes recessed areas and openings for tape feeding, ensuring precise alignment. A top member of the taping member, connected via hinges, can close onto the zipper, trapping the zipper in place within the member for the tape application from both rolls onto each side of the zipper while the zipper is pulled through the member.

13 Claims, 6 Drawing Sheets

ZIPPER TAPE APPLICATOR DEVICE

CROSS-REFERENCE TO RELATED APPLICATION

The present application claims priority to, and the benefit of, U.S. Provisional Application No. 63/461,036, which was filed on Apr. 21, 2023, and is incorporated herein by reference in its entirety.

FIELD OF THE INVENTION

The present invention relates generally to the field of zippers. More specifically, the present invention relates to a zipper tape applicator device that receives multiple tape rolls and allows a zipper to be pulled through the device to easily apply tape from each roll to one half of the zipper. Accordingly, the present disclosure makes specific reference thereto. Nonetheless, it is to be appreciated that aspects of the present invention are also equally applicable to other like applications, devices, and methods of manufacture.

BACKGROUND

The process of manually applying double-sided tape to both halves of a zipper frequently leads to issues stemming from human error and inconsistencies in the taping process. This task can be particularly challenging because it necessitates precision and careful handling to ensure that the tape is applied evenly and accurately along the length of each zipper half. Unfortunately, due to the inherent variability in human performance and the meticulous attention to detail required, the outcomes often exhibit a lack of uniformity.

Moreover, individuals involved in this task may find themselves losing a considerable amount of time. This is not merely a consequence of the complexity of taping each side of the zipper separately but also arises from the inevitable corrections and adjustments needed when mistakes occur. The requirement for separate taping of each zipper side adds layers of complexity and time consumption, as each half must be handled as an independent task that demands its own set of precision and care.

Furthermore, the manual application of tape to zippers is not just time-intensive but also space-intensive. It requires a significant amount of workspace, as individuals need ample room to lay out the zippers, handle the tape, and maneuver around the materials without causing entanglements or errors. The spatial demands of this task can become a logistical challenge in environments where space is at a premium, compounding the difficulties of manual taping with the need for efficient organization and management of the workspace.

Therefore, there exists a long-felt need in the art for a device for applying tape to a zipper. There also exists a long-felt need in the art for a zipper tape applicator device. More specifically, there exists a long-felt need in the art for a zipper tape applicator device that can easily apply tape to both halves of a zipper. Further, there exists a long-felt need in the art for a zipper tape applicator device that can apply tape to both halves of a zipper wherein the device requires minimal space to operate.

The subject matter disclosed and claimed herein, in one embodiment thereof, comprises a zipper tape applicator device. The device is designed for the efficient application of tape to both sides of a zipper assembly. The device comprises a base equipped with a fastener opening for securing it to a surface, and two parallel vertical members featuring cutouts to hold the axle of a spool assembly. The spool assembly is comprised of two halves and a spacer, with the axles allowing the assembly to spin freely while securing two rolls of tape. Positioned above the base and spool assembly is a taping member with a top surface designed to guide tape from the rolls to the zipper placed upon the member. More specifically, the member includes recessed areas and openings for tape feeding, ensuring precise alignment. A top member of the taping member, connected via hinges, can close onto the zipper, trapping the zipper in place within the member for the tape application from both rolls onto each side of the zipper. This arrangement allows for the zipper to be easily pulled through, applying tape along its length before the tape is trimmed and the zipper is removed from the device.

In this manner, the zipper tape applicator device of the present invention accomplishes all the forgoing objectives and provides a device that allows a user to easily apply tape to both halves of a zipper. While doing so, the device requires minimal space to operate.

SUMMARY

The following presents a simplified summary to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a zipper tape applicator device that allows a user to easily apply tape to the bottom surface of both sides of a zipper assembly. The device is comprised of a base comprised of at least one, but preferably two parallel vertical members. Each vertical member is comprised of at least one cutout that preferably removably receives at least one axle of at least one spool assembly. The spool assembly is comprised of a first half, at least one spacer, and a second half. During use, the device is preferably used with at least one, but preferably two, tape rolls. In this embodiment, the first half of the spool assembly is placed through the first tape roll from a first side of the tape roll. Then, the spacer is attached to the first half on a second side of the tape roll. Next, the second half of the spool assembly is placed through the second tape roll from a first side of the tape roll. Then, the second half is attached to the spacer on the second side of the second tape roll. Finally, at least one axle is placed through both halves and the spacer such that the spool assembly is completed while housing two tape rolls.

After tape rolls have been loaded onto the spool, the axle of the spool can be placed into the cutouts of the vertical members such that the spool is suspended above the base and can spin freely. The device is also comprised of at least one taping member positioned above the spool and the base. The member is comprised of a top surface comprised of at least one (but preferably two) recessed area(s) and opening(s) that allow tape to be fed through the openings and onto the top surface. The recessed areas secure the tape on the top surface during use. The openings are preferably positioned in the recessed areas.

After being fed through the openings, a zipper assembly can be placed onto the top surface such that the tape from the first tape roll contacts a first side of the zipper and a tape from the second tape roll contacts a second side of the zipper. Then, at least one top member can be closed onto the zipper to trap the zipper within the member, via at least one hinge that attaches the top member to the taping member. Once closed within the member, the zipper can be pulled through the member such that the tape from both rolls is applied to the entire length of the zipper, wherein the tape can then be trimmed as needed and the zipper can be removed from the device.

The present invention is also comprised of a method of using the device. First, a device is provided comprised of at least one spool assembly, a taping member, and a base comprised of at least one vertical member. Then, at least one tape roll can be secured to the spool assembly in a manner described above. Then, the spool assembly can be attached to the vertical member. Next, tape from the roll can be fed through at least one opening of the taping member. Finally, a zipper can be placed onto a top surface of the taping member and a top member can be closed onto the zipper such that the zipper can be pulled through the member to apply the tape to the bottom surface of the zipper.

Accordingly, the zipper tape applicator device of the present invention is particularly advantageous as it provides a device that allows a user to easily apply tape to both halves of a zipper. While doing so, the device requires minimal space to operate. In this manner, the zipper tape applicator device overcomes the limitations of existing devices and techniques used to apply tape to both halves of a zipper.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION

Figure 1:
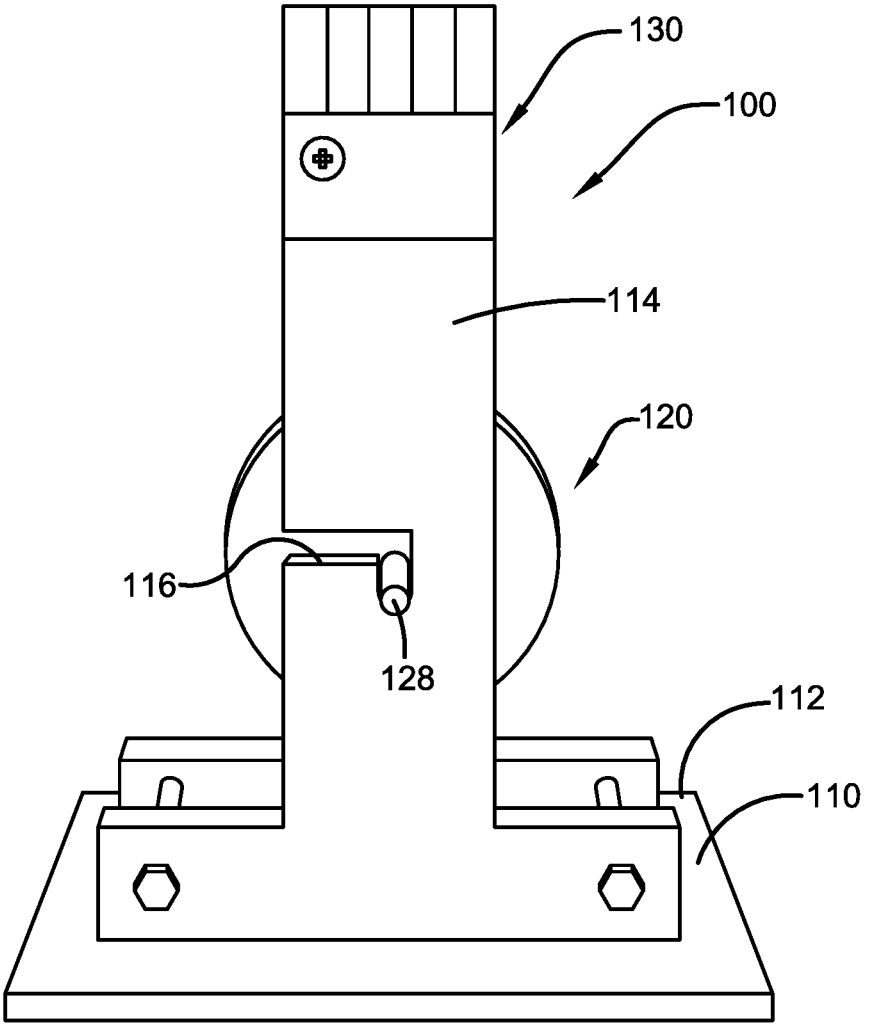
FIG. 1 illustrates a side view of one potential embodiment of a zipper tape applicator device of the present invention in accordance with the disclosed architecture.

The innovation is now described with reference to the drawings, wherein like reference numerals are used to refer to like elements throughout. In the following description, for purposes of explanation, numerous specific details are set forth to provide a thorough understanding thereof. It may be evident, however, that the innovation can be practiced without these specific details. In other instances, well-known structures and devices are shown in block diagram form to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there exists a long-felt need in the art for a device for applying tape to a zipper. There also exists a long-felt need in the art for a zipper tape applicator device. More specifically, there exists a long-felt need in the art for a zipper tape applicator device that can easily apply tape to both halves of a zipper. Further, there exists a long-felt need in the art for a zipper tape applicator device that can apply tape to both halves of a zipper wherein the device requires minimal space to operate.

The present invention, in one exemplary embodiment, is comprised of a zipper tape applicator device designed to facilitate the easy application of tape to the bottom surface of both sides of a zipper assembly. This device is composed of a base featuring at least one, but preferably two, parallel vertical members, each with at least one cutout designed to removably receive the axle of one or more spool assemblies. The spool assembly includes a first half, one or more spacers, and a second half, intended to be used with one or two tape rolls. The device functions by placing a spool assembly, equipped with tape rolls, onto the base such that it can spin freely, and utilizing at least one taping member positioned above to guide the tape from the rolls onto a zipper placed on the device's surface. This system allows for the tape to be applied to the entire length of the zipper as it is pulled through the taping member, after which the tape can be trimmed, and the zipper removed.

Referring initially to the drawings, FIG. 1 illustrates a side view of one potential embodiment of a zipper tape applicator device 100 of the present invention in accordance with the disclosed architecture. The device 100 allows a user to easily apply tape 170 to the bottom surface 20 of both sides of a zipper assembly 10. The device 100 is comprised of a base 110. The base 110 may be comprised of at least one fastener opening 112. The opening 112 allows at least one fastener, such as but not limited to a screw or a bolt, to be placed through the opening 112 to secure the base 110 and device 100 to a surface prior to use.

Figure 2:
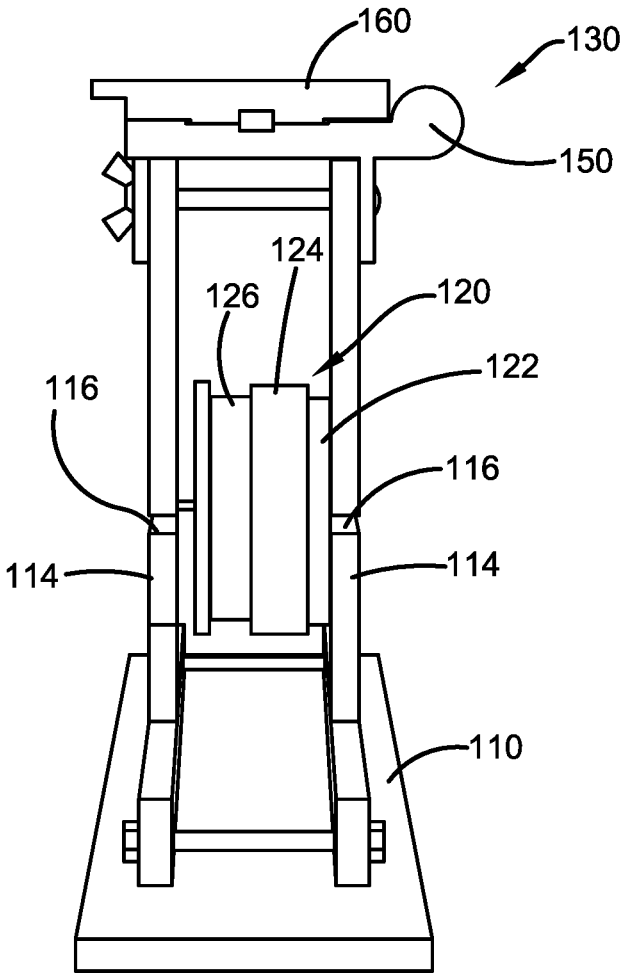
FIG. 2 illustrates a front view of one potential embodiment of a zipper tape applicator device of the present invention in accordance with the disclosed architecture.

The base 110 is also comprised of at least one, but preferably two parallel vertical (relative to the vertical axis of each member 114) members 114. Each vertical member 114 is comprised of at least one cutout 116. The cutout 116 removably receives at least one axle 128 of at least one spool assembly 120, as seen in FIG. 2. More specifically, the spool assembly 120 is comprised of a first half 122, at least one spacer 124, and a second half 126. During use, the device 100 is preferably used with at least one, but preferably two, tape rolls 170. In this embodiment, the first half 122 of the spool assembly 120 is placed through the first tape roll 170 from a first side of the tape roll 170. Then, the spacer 124 is attached to the first half 122 on a second side of the tape roll 170. Next, the second half 126 of the spool assembly 120 is placed through the second tape roll 170 from a first side of the tape roll 170. Then, the second half 126 is attached to the spacer 124 on the second side of the second tape roll 170. Finally, at least one axle 128 is placed through both halves 122,126 and the spacer 124 such that the spool assembly 120 is completed while housing two tape rolls 170. The halves 122,126 and spacer 124 may attach via any fastener or attachment means.

Figure 3:
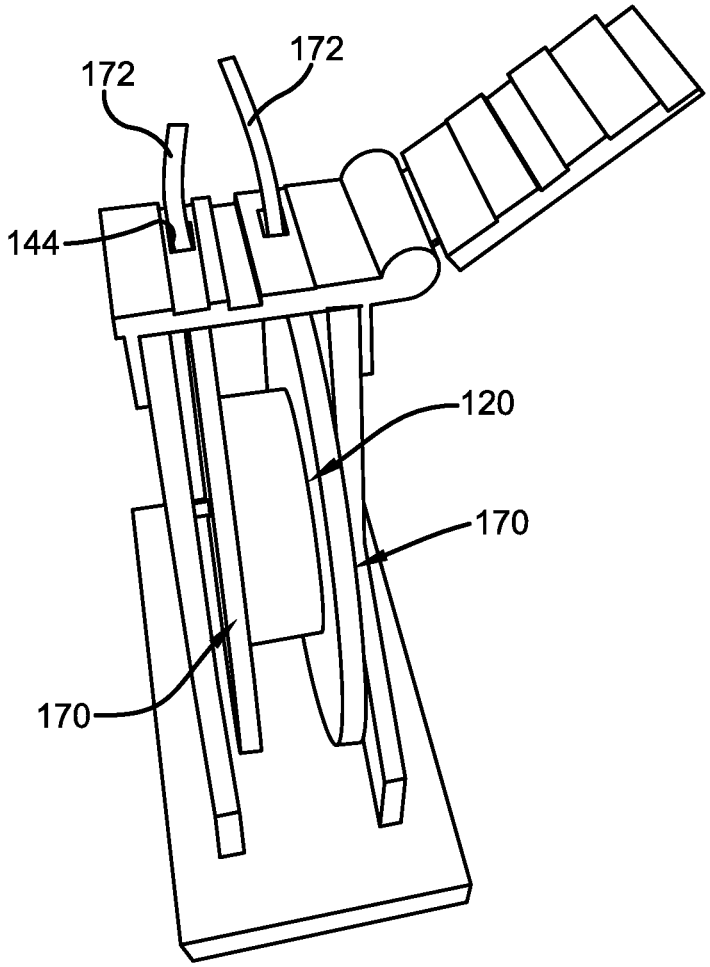
FIG. 3 illustrates a perspective view of one potential embodiment of a zipper tape applicator device of the present invention wherein the top member is not closed onto the taping member in accordance with the disclosed architecture.

After tape rolls 170 have been loaded onto the spool 120, the axle 128 of the spool 120 can be placed into the cutouts 116 of the vertical members 114 such that the spool 120 is suspended above the base 110 and can spin freely. The device 100 is also comprised of at least one taping member 130 positioned above the spool 120 and the base 110, wherein the member 130 may be removably or fixedly attached to the vertical members 114. The member 130 is comprised of a top surface 140 comprised of at least one (but preferably two) recessed area(s) and opening(s) 144. The openings 144 allow tape 170 to be fed through the openings 144 and onto the top surface 140, as seen in FIG. 3. The recessed areas 142 secures the tape 170 on the top surface 140 during use. The openings 144 are preferably positioned in the recessed areas 142.

Figure 4:
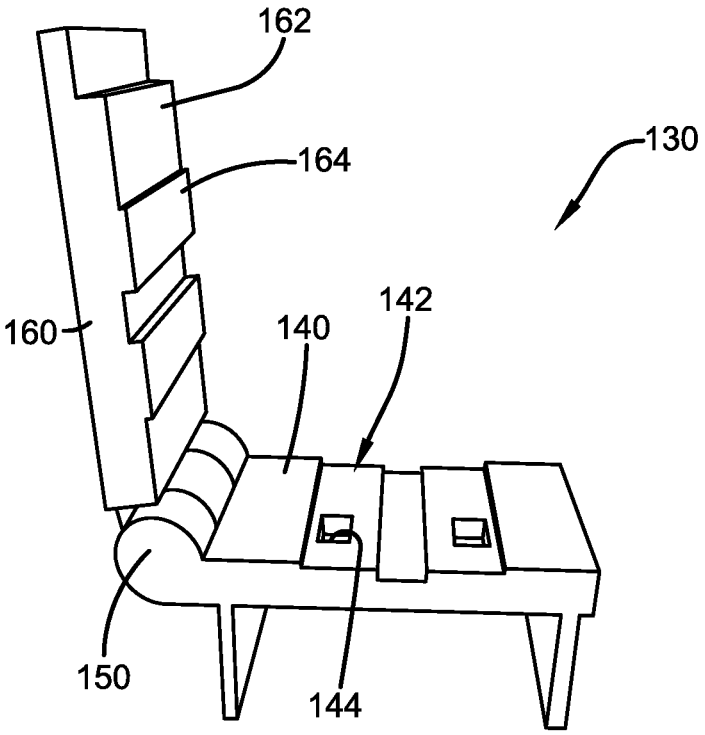
FIG. 4 illustrates a front view of a taping member, hinge, and top member of one potential embodiment of a zipper tape applicator device of the present invention wherein the top member is not closed onto the taping member in accordance with the disclosed architecture.
Figure 5:
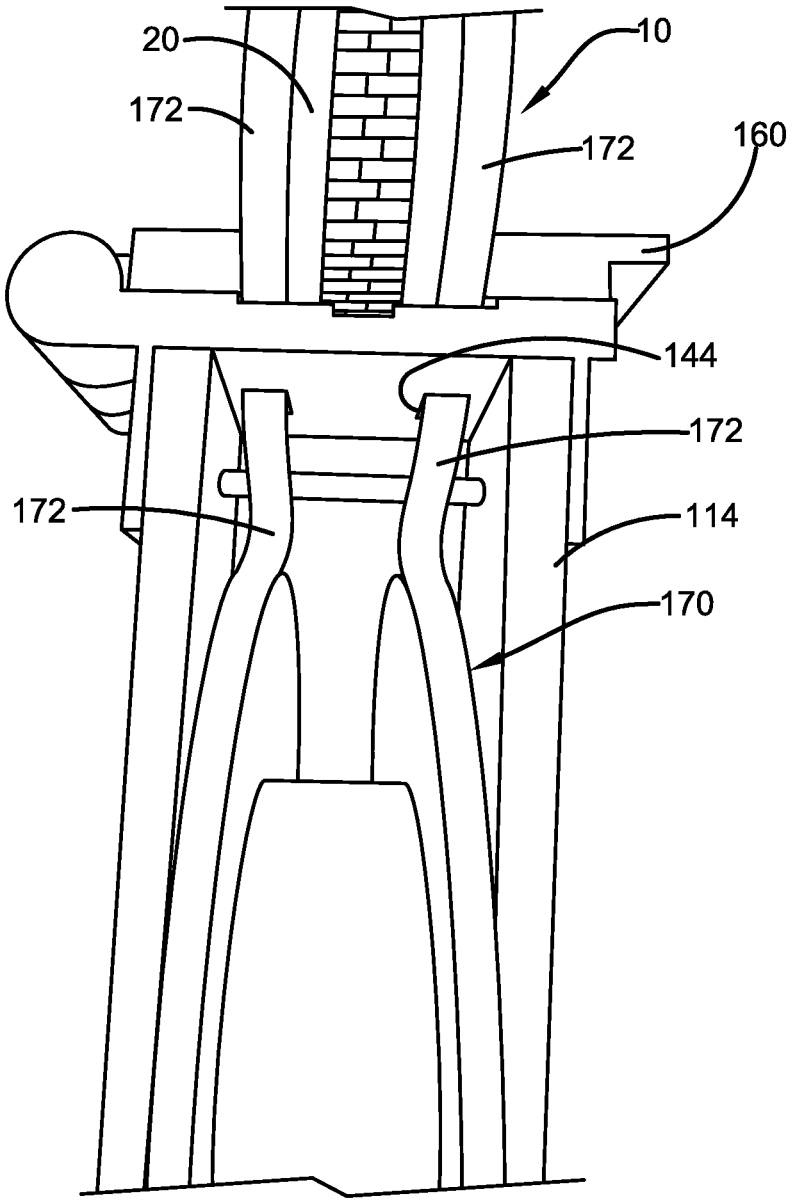
FIG. 5 illustrates a front view of one potential embodiment of a zipper tape applicator device of the present invention wherein the top member is closed onto the taping member and a zipper is being used within the device in accordance with the disclosed architecture.

After being fed through the openings 144, a zipper assembly 10 can be placed onto the top surface 140 such that the tape 172 from the first tape roll 170 contacts a first side of the zipper 10 and a tape 172 from the second tape roll 170 contacts a second side of the zipper 10. Then, at least one top member 160 can be closed onto the zipper 10 to trap the zipper within the member 130, via at least one hinge 150 that attaches the top member 160 to the taping member 130, as seen in FIG. 5. The bottom surface 162 of the top member 160 is comprised of at least one, but preferably two, extruded areas 164 (as seen in FIG. 4) that align with the recessed areas 142 of the top surface 140 to ensure proper alignment and application of the tape 172 on each side of the zipper 10. Once closed within the member 130, the zipper 10 can be pulled through the member 130 such that the tape 172 from both rolls 170 is applied to the entire length of the zipper 10, wherein the tape can then be trimmed as needed and the zipper 10 can be removed from the device 100.

Figure 6:
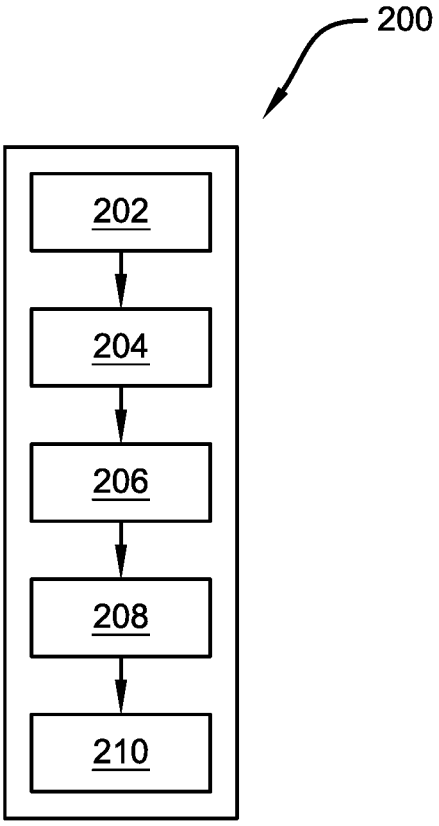
FIG. 6 illustrates a flowchart of a method of using one potential embodiment of a zipper tape applicator device of the present invention in accordance with the disclosed architecture.

The present invention is also comprised of a method of using 200 the device 100, as seen in FIG. 6. First, a device 100 is provided comprised of at least one spool assembly 120, a taping member 130, and a base 110 comprised of at least one vertical member 114 [Step 202]. Then, at least one tape roll 170 can be secured to the spool assembly 120 in a manner described above [Step 204]. Then, the spool assembly 120 can be attached to the vertical member 114 [Step 206]. Next, tape 172 from the roll 170 can be fed through at least one opening 144 of the taping member 130 [Step 208]. Finally, a zipper 10 can be placed onto a top surface 140 of the taping member 130 and a top member 160 can be closed onto the zipper 10 such that the zipper 10 can be pulled through the member 130 to apply the tape 172 to the bottom surface 20 of the zipper [Step 210].

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "zipper tape applicator device" and "device" are interchangeable and refer to the zipper tape applicator device 100 of the present invention.

Notwithstanding the forgoing, the zipper tape applicator device 100 of the present invention and its various components can be of any suitable size and configuration as is known in the art without affecting the overall concept of the invention, provided that they accomplish the above-stated objectives. One of ordinary skill in the art will appreciate that the size, configuration, and material of the zipper tape applicator device 100 as shown in the FIGS. are for illustrative purposes only, and that many other sizes and shapes of the zipper tape applicator device 100 are well within the scope of the present disclosure. Although the dimensions of the zipper tape applicator device 100 are important design parameters for user convenience, the zipper tape applicator device 100 may be of any size, shape, and/or configuration that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications, and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A zipper tape applicator device comprising:
- a base;
- a first vertical member;
- a spool assembly comprised of an axle; and
- a taping member comprised of an opening;
- a top member; and
- a hinge, wherein a top surface of the taping member is comprised of a recessed area and further wherein a bottom surface of the top member is comprised of an extruded area that aligns with the recessed area.

2. The zipper tape applicator device of claim 1 further comprised of a second vertical member that is positioned parallel relative to a vertical axis of the first vertical member.

3. The zipper tape applicator device of claim 1, wherein the spool assembly is comprised of a first half, a spacer, and a second half.

4. The zipper tape applicator device of claim 1, wherein the base is comprised of an opening.

5. The zipper tape applicator device of claim 1, wherein the taping member is removably attached to the first vertical member.

6. The zipper tape applicator device of claim 1, wherein the opening is positioned within the recessed area.

7. The zipper tape applicator device of claim 1, wherein the top member is attached to the taping member via the hinge.

8. A zipper tape applicator device comprising:

a base;

a first vertical member comprised of a first cutout;

a second vertical member comprised of a second cutout;

a spool assembly comprised of an axle;

a taping member comprised of an opening;

a top member; and a hinge, wherein a top surface of the taping member is comprised of a recessed area and further wherein a bottom surface of the top member is comprised of an extruded area that aligns with the recessed area.

9. The zipper tape applicator device of claim 8, wherein the cutout receives the axle.

10. The zipper tape applicator device of claim 8, wherein the spool assembly is comprised of a first half, a spacer, and a second half.

11. The zipper tape applicator device of claim 8, wherein the base is comprised of an opening.

12. The zipper tape applicator device of claim 8, wherein the axle is removably secured to the first vertical member via the cutout.

13. The zipper tape applicator device of claim 8, wherein the opening is positioned within the recessed area.

* * * * *